US010849418B2

(12) United States Patent
Taylor

(10) Patent No.: US 10,849,418 B2
(45) Date of Patent: Dec. 1, 2020

(54) PAINT PEN

(71) Applicant: Bruce John Taylor, Fort Worth, TX (US)

(72) Inventor: Bruce John Taylor, Fort Worth, TX (US)

( * ) Notice: Subject to any disclaimer, the term of this patent is extended or adjusted under 35 U.S.C. 154(b) by 0 days.

(21) Appl. No.: 16/287,699

(22) Filed: Feb. 27, 2019

(65) Prior Publication Data

US 2019/0269235 A1 Sep. 5, 2019

Related U.S. Application Data

(60) Provisional application No. 62/637,216, filed on Mar. 1, 2018.

(51) Int. Cl.
*A46B 11/00* (2006.01)
*B43K 1/08* (2006.01)

(52) U.S. Cl.
CPC ..... *A46B 11/0041* (2013.01); *A46B 11/002* (2013.01); *B43K 1/082* (2013.01); *A46B 2200/205* (2013.01)

(58) Field of Classification Search
CPC ..... A46B 11/0041; A46B 2200/205; A46B 11/00; A46B 11/0006; A46B 11/001; A46B 11/002; A46B 11/0065; A46B 11/0072; A46B 11/0089; A46B 11/06; A46B 2200/202; B43K 7/00; B43K 7/02; B43K 8/00; B43K 8/02; B43K 8/026; B43K 1/082
USPC ..... 401/268, 270, 273, 278, 282, 285
See application file for complete search history.

(56) References Cited

U.S. PATENT DOCUMENTS 1,350,734 A 8/1920 Overlin
2,673,362 A * 3/1954 Robinson ..... A46B 11/0013 401/186
2,927,625 A * 3/1960 Rothermel ..... B29D 23/18 156/144
2,962,398 A 11/1960 Jones
3,285,228 A 11/1966 Fisher
4,881,088 A 11/1989 Fisher, Jr. et al.
4,946,302 A * 8/1990 Uchida ..... A45D 34/042 401/273
5,123,766 A 6/1992 Babiak
5,560,769 A 10/1996 Conner et al.
5,683,013 A 11/1997 Morrison
5,938,360 A * 8/1999 Yen ..... B43K 7/00 401/206
5,957,606 A * 9/1999 Jafarmadar ..... A46B 11/0013 401/137
6,048,914 A 4/2000 Goto et al.
6,224,284 B1 5/2001 Sukhna et al.
6,450,724 B1 * 9/2002 Cambio ..... B43M 11/08 401/183
6,749,356 B1 * 6/2004 Mead ..... B05C 17/0136 401/176

(Continued)

*Primary Examiner* — David J Walczak

(57) ABSTRACT

The invention is directed to a paint pen having a squeezable paint reservoir, a flexible and resilient tube connected at one end to the reservoir and at the other end to a tip comprising an absorbent and permeable material (relative to the paint in the reservoir). The pen operates by squeezing the tube to provide paint through the tube to the tip at which point it can be applied to a surface. The flexibility and resilience of the tube enables uniform application of the paint to rough surfaces.

5 Claims, 5 Drawing Sheets

(56) References Cited

U.S. PATENT DOCUMENTS

| | | | | |
|---|---|---|---|---|
| 6,805,512 | B2 * | 10/2004 | King | A45D 34/045 401/133 |
| 6,881,000 | B2 | 4/2005 | Perlman et al. | |
| 7,083,353 | B2 | 8/2006 | Venugopalan | |
| 7,208,036 | B2 | 4/2007 | Fukuo | |
| 7,819,601 | B2 | 10/2010 | Taniguchi | |
| 8,985,884 | B2 | 3/2015 | Nakamura et al. | |
| 2002/0159817 | A1 | 10/2002 | Brand et al. | |
| 2007/0292197 | A1 | 12/2007 | Peterson et al. | |
| 2008/0277630 | A1 | 11/2008 | Kiyoshima et al. | |
| 2012/0316276 | A1 | 12/2012 | Iwasa et al. | |

* cited by examiner

PAINT PEN

CROSS-REFERENCE TO RELATED APPLICATIONS

This application claims the benefit of U.S. Provisional Application No. 62/637,216, filed on Mar. 1, 2018.

BACKGROUND AND SUMMARY

This invention pertains generally to technology for paint pens. More specifically, the invented technology is directed to enabling paint pens to write with the disbursement point (the pen "tip") higher than the paint reservoir and to write on a variety of surfaces.

Paint pens (also known as paint markers) are well known in the art. Their failings are also well known. Specifically, the prior-art paint pens consistently fail to deliver sufficient paint to the tip of the pen when writing with the tip higher than the paint reservoir (i.e., with the pen angled "up"). When attempting to write in this configuration, the user is forced to frequently pause and reorient or shake the pen to encourage paint to the tip. Thus, the process of writing "up" is iterative: write, pause, reorient/shake, and repeat. This is slow and frustrating to the user.

Another failing of the prior-art paint pens is that they are practically useless on certain surfaces (typically, rough surfaces) because the volume of paint at the tip is insufficient for the surface or the tip of the pen is too rigid to conform to the surface when writing. When writing on such a surface (even with the pen tip oriented "down"), the result is typically gap-filled: paint deposits on some spots and not others. Thus, the mark intended by the user is seldom the mark the user gets—unless he repeats the process. This is slow and frustrating to the user.

The main prior-art approach to address the prior-art failings is to pressurize the paint reservoir by pumping. Not only is this approach only marginally successful, it is cumbersome. For larger marks, the user must periodically stop writing in order to pump and thereby pressurize the reservoir. Thus, marking with a paint pen is still slow and frustrating to the user. Accordingly, there is a need for an improved paint pen—one that is simple and easy to use yet delivers sufficient paint to the tip at a continuous point of contact with the surface.

A paint pen according to an aspect of the invention includes a squeezable reservoir to hold the paint, an absorbent/permeable material to disburse paint (the tip of the pen), and an elongated flexible and resilient tube to deliver the paint from the reservoir to the tip. The absorbent/permeable material is disposed at least partially within the elongated tube. By slightly squeezing the reservoir, the paint is pushed to the absorbent/permeable material at which point it flows through the material to be deposited on the object marked with the pen. The absorbent/permeable material may be uniform (e.g., a sponge) or an assembly of materials (e.g., bristles or tiny tubes).

BRIEF DESCRIPTION OF THE DRAWINGS

These and other features, aspects, and advantages of the present invention will be better understood with reference to the following description, appended claims, and accompanying drawings where:

DETAILED DESCRIPTION

Figure 1A:
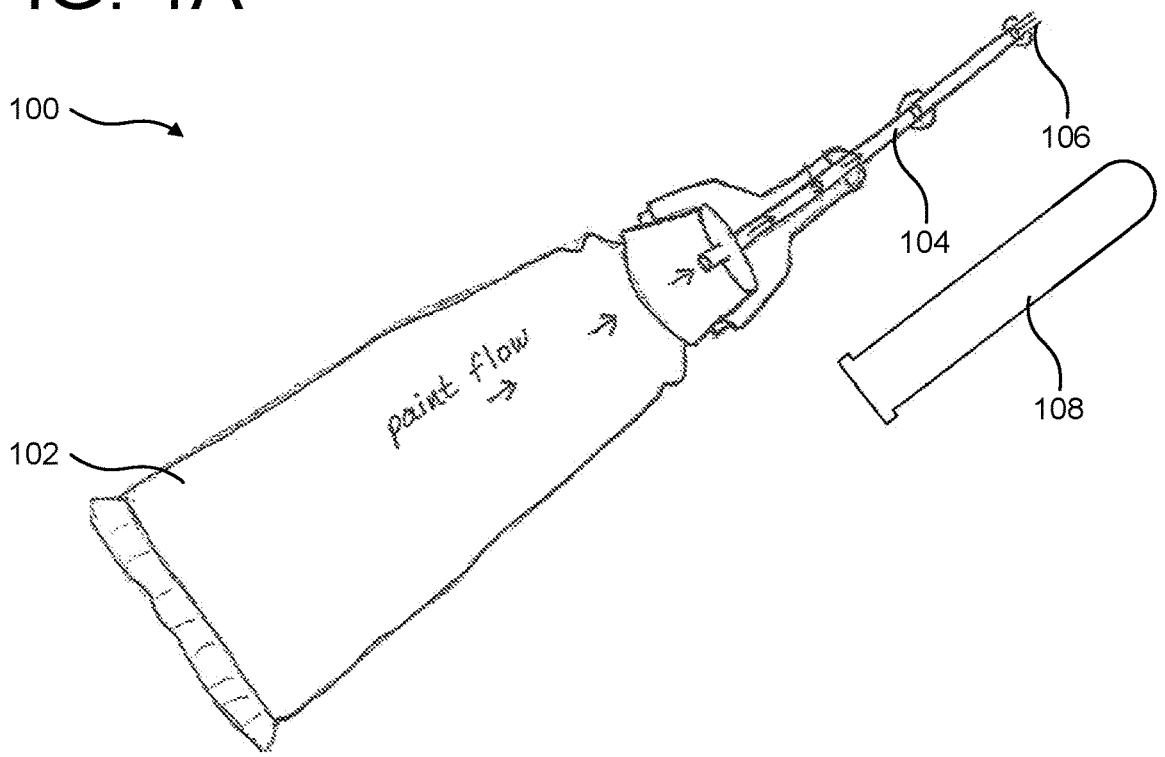
FIGS. 1A and 1B depict an exemplary paint pen according to an aspect of the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

Figure 1B:
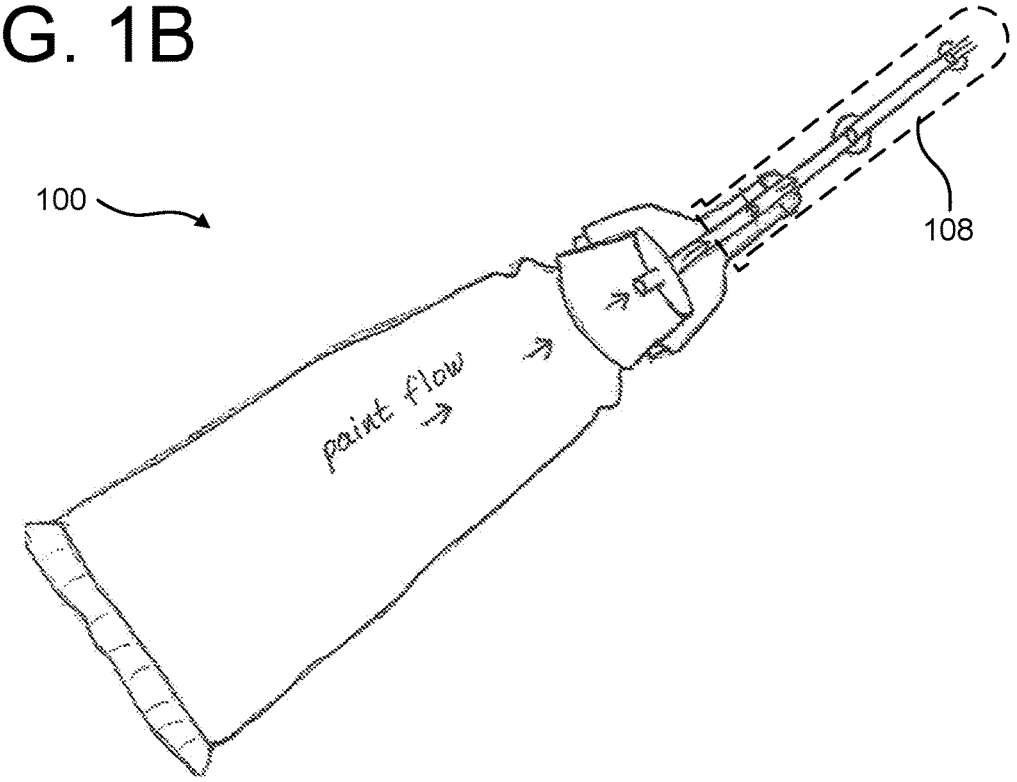

An exemplary paint pen 100 in FIGS. 1A and 1B includes a squeezable reservoir 102, and an elongated tube 104 connected to the reservoir at one end and terminating at the other end with a tip 106 comprising absorbent/permeable material. As depicted in FIG. 1B, a cap 108 may be placed on the elongated tube 104 and tip 106 when the pen 100 is not in use. When installed, the cap 108 provides an airtight space about the tip 106 that helps prevent the tip 106 from drying. Preferably, the cap 108 is designed to minimize the volume of air within the cap when installed. In one embodiment, the cap may include an absorbent material to hold, e.g., a distillate to help prevent the tip 106 from drying. In some embodiments, the tube 104 may be attached to the reservoir 102 through a threaded connector.

Figure 2A:
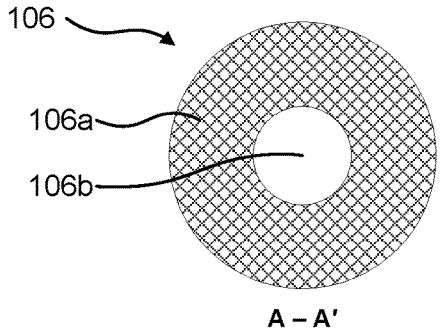
FIGS. 2A and 2B depict an exemplary paint-pen tube and tip according to an aspect of the invention.

The absorbent/permeable tip 106 both holds paint from the reservoir 102 (it absorbs the paint) and allows paint to flow through to the object being marked (it is permeable to the paint). This helps control the volume of paint delivered to the object. In one embodiment, depicted in FIGS. 2A (section view) and 2B (side view), the tip 106 includes an assembly of small-diameter bristles 106*a* (shown in cross-hatch in FIG. 2A) with one end of the bristles installed in the channel of the tube 104 and the other end extending from the tube 104. The bristles are densely packed, forming a circular cross section, but include an opening 106*b* roughly in the center of the circular cross section. The bristles may be of uniform or a variety of diameters. In one embodiment, the opening 106*b* has a roughly circular cross section with a diameter of 0.08 inches. Alternatively, the tip may not include the opening 106*b* and the permeability of the bristle assembly may be set the by the bristle diameter (which sets the size of the channels between the packed bristles). In another alternative, the bristle assembly 106*a* may be replaced with a cylindrical sponge with a cylindrical cross section and through channels (e.g., longitudinally oriented slits or holes) to set the permeability to the paint (which permeability is preferably directional). In another embodiment, the bristle assembly 106*a* may be replaced with an assembly of small-diameter tubes, with the channels within and between tubes setting the permeability to the paint.

The elongated tube 104 is preferably constructed of a resilient and flexible polymer to provide the flexing capabilities that enable the tube 104 to deliver paint to almost any surface: it can flex while the tip 106 is drawn across a rough surface. The resiliency of the tube 104 may be augmented by circumferential ridges (not shown) about the tube 104. The resiliency enables flexing without kinking or crushing the tube 104. The elongated tube 104 has a channel through which the paint is squeezed from the reservoir 102 to the tip 106. In one embodiment, the channel has a circular cross section with a diameter equal to 0.1 inch and the tube 104 has a wall 0.005 inches thick.

Figure 3A:
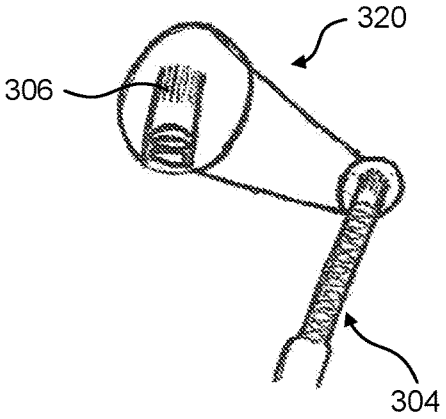
FIGS. 3A and 3B depict an exemplary paint-pen tube and tip according to an aspect of the invention.
Figure 3B:
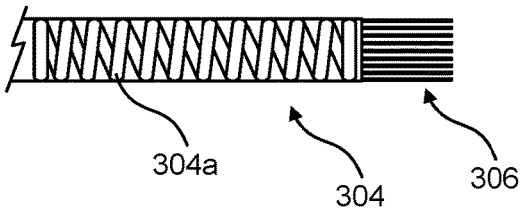

In another embodiment of an elongated tube and tip, depicted in FIGS. 3A (a perspective view) and 3B (a side view), a flexible elongated tube 304 includes a spring 304*a* disposed in the inner channel of the tube 304 and terminates in a tip 306 (shown magnified in view 320). The spring 304*a* provides the flexing/resiliency capabilities that enable the tube 304 to deliver paint to almost any surface: it can flex without kinking while the tip 306 is drawn across a rough surface. In the depicted embodiment, the absorbent/permeable tip is created from the material of the tube 304 itself, by splitting or fraying the tube 304 at the tip 306 to create bristle-like pieces.

Figure 4A:
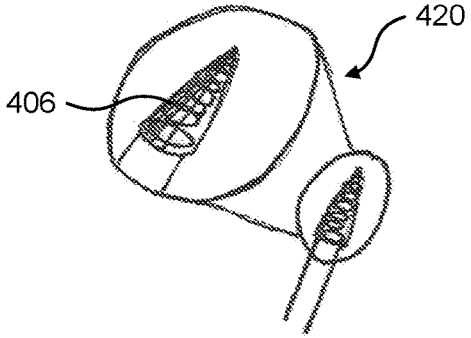
FIGS. 4A and 4B depict an exemplary paint-pen tip according to an aspect of the invention.
Figure 4B:
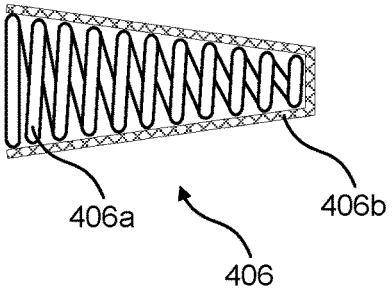

Another alternative tip embodiment is depicted in FIGS. 4A (a perspective view) and 4B (a side view). Here, the tip 406 (shown magnified in view 420) includes a conical spring 406*a* that is wrapped in an absorbent/permeable material 406*b*. For example, the wrapping material 406*b* may be a bristle assembly, a sponge, or fabric. The spring 406*a* provides the tip with flexibility and resilience to enable the tip 306 to deliver paint to almost any surface: it can flex without collapsing while drawn across a rough surface.

Figure 5A:
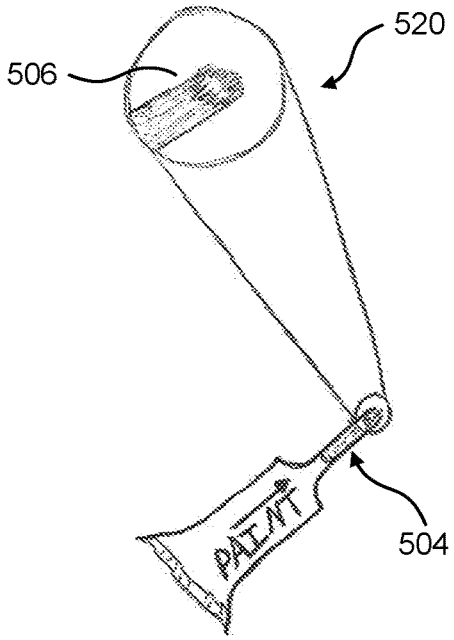
FIGS. 5A and 5B depict an exemplary paint-pen tube and tip according to an aspect of the invention.
Figure 5B:
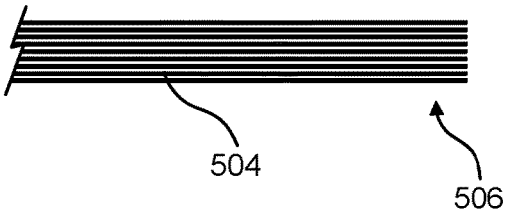

Another alternative tube and tip embodiment in depicted in FIGS. 5A (perspective view) and 5B (side view). Here, a tube 504 is shaped by a bristle assembly, the terminal point of which forms a tip 506 (shown magnified in view 520).

Figure 2B:
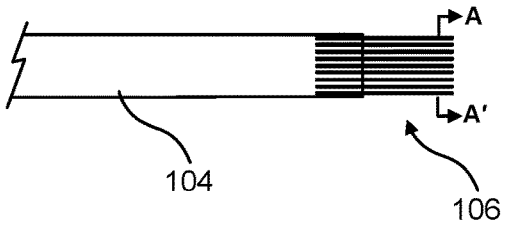
Figure 6A:
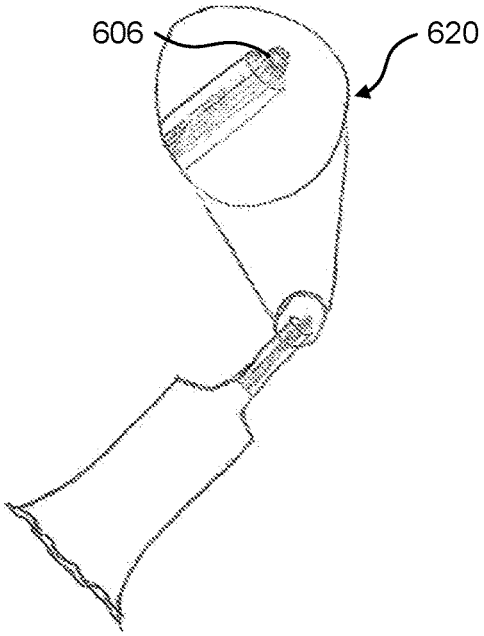
FIGS. 6A and 6B depict an exemplary paint-pen tube and tip according to an aspect of the invention.
Figure 6B:
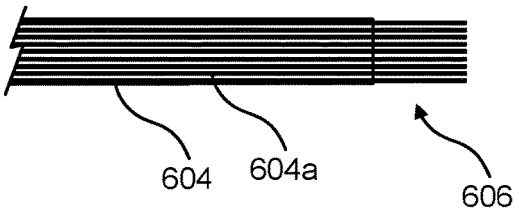

Another alternative tube and tip embodiment is depicted in FIGS. 6A (perspective view) and 6B (side view). Here, a bristle assembly 604*a* is disposed within and along the entire length of a tube 604, from tip 606 (also shown magnified in view 620) to reservoir. This embodiment may be implemented with or without the center opening in the bristle assembly described with reference to FIGS. 2A and 2B.

Figure 7A:
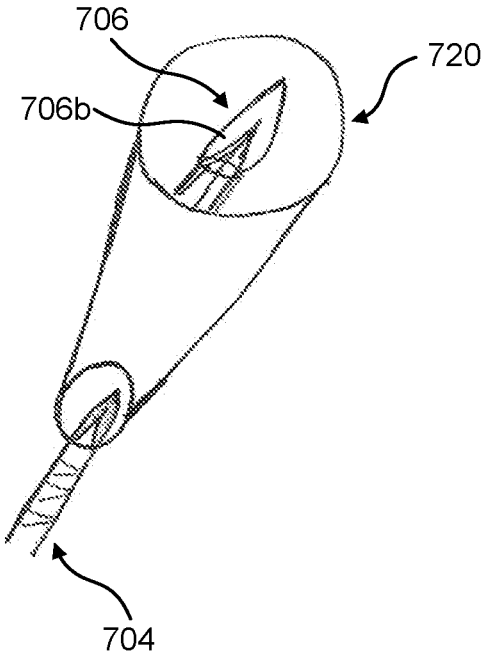
FIGS. 7A and 7B depict an exemplary paint-pen tube and tip according to an aspect of the invention.
Figure 7B:
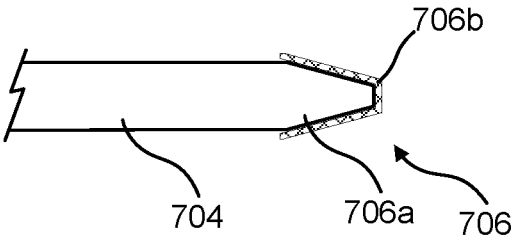

An alternative tip embodiment is depicted in FIGS. 7A (a perspective view) and 7B (a side view). Here, the tip 706 (shown magnified in view 720) includes a conical portion 706*a* of a tube 704. The conical portion 706*a* is wrapped in an absorbent/permeable material 706*b* such as felt. The conical portion 706*a* provides the tip 706 with the flexibility and resilience that enables the tip 706 to deliver paint to almost any surface: it can flex without collapsing while drawn across a rough surface. In an alternative embodiment, the conical portion 706*a* is provided by a tube liner rather than being integrally formed with the tube. In either approach, the conical portion 706*a* includes holes to allow paint from the reservoir to pass (it is permeable to the paint).

Figure 8:
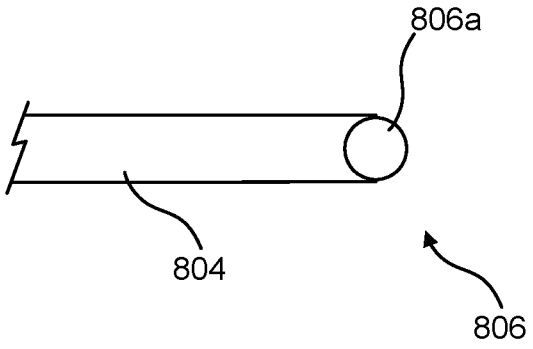
FIG. 8 depicts an exemplary paint-pen tip according to an aspect of the invention.

Another alternative tip embodiment is depicted in FIG. 8 (a side view). In this embodiment, the tube 804 terminates in a ball 806*a* to form the tip 806. Here, the flexible tube 804 delivers paint to the ball 806*a* that when rolled across a surface delivers paint to the surface in a manner similar to how a ballpoint pen deliver ink to paper. But the flexibility and resilience of the tube 804 enables more reliable contact between the surface and ball 806*a* than with a rigidly deployed ball point.

Figure 9:
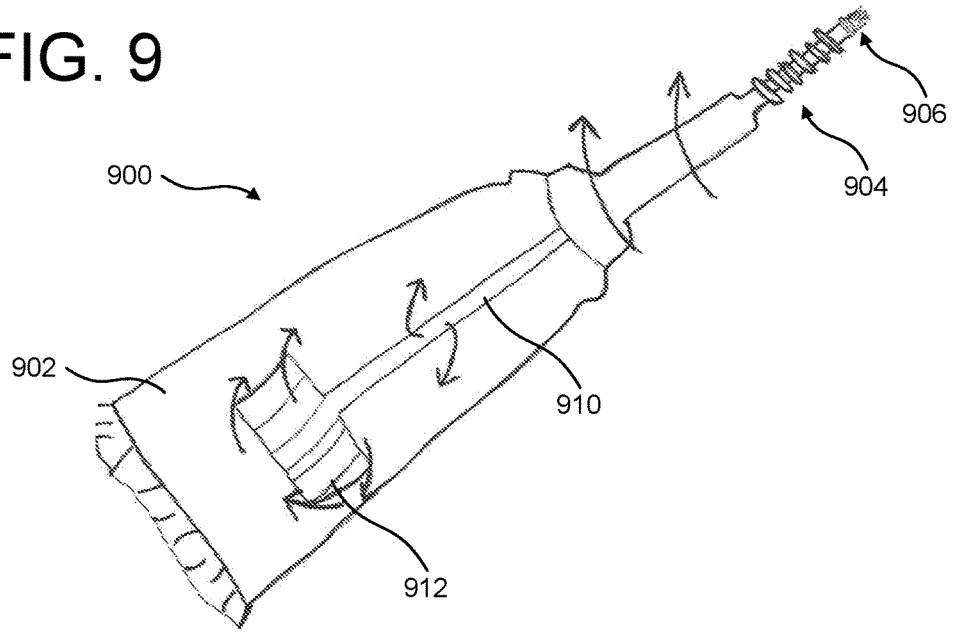
FIG. 9 depicts an exemplary paint pen according to an aspect of the invention.
Figure 10:
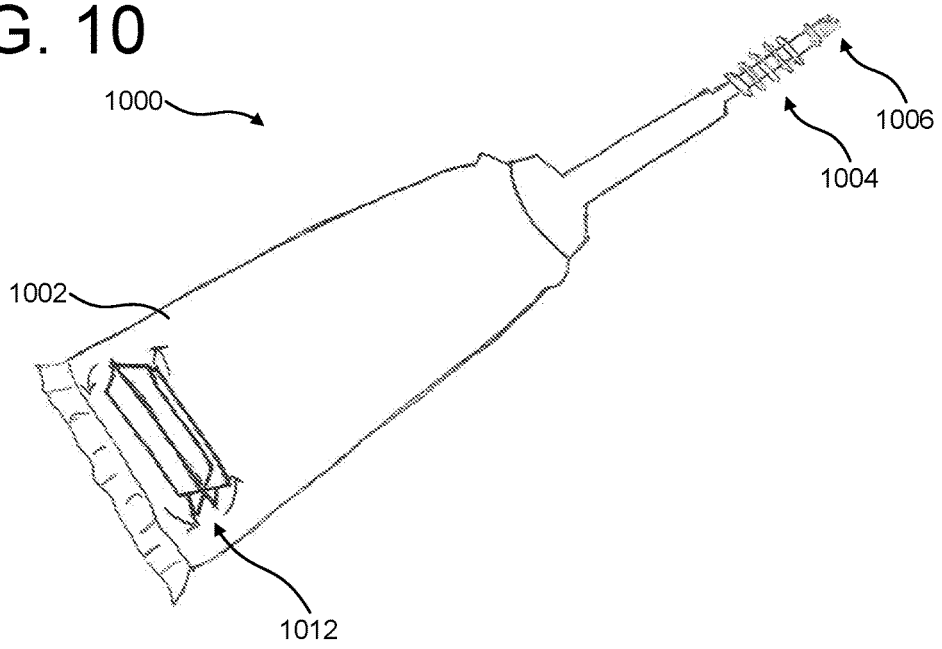
FIG. 10 depicts an exemplary paint pen according to an aspect of the invention.

FIGS. 9 and 10 depict further aspects of the invention embodied in exemplary paint pens. In FIG. 9, a pen 900 includes a flexible tube 904 (shown here with circumferential ridges for tube resiliency) and a absorbent/permeable tip 906 (as already described). The pen 900 further includes a mixing paddle 912 disposed within a reservoir 902. The paddle 912 is preferably constructed of resilient and flexible material. Rotation of the paddle 912, through, e.g., rotation of the tube 904 and a rod 910 connecting the tube 904 to the paddle 912, stirs the paint within the reservoir 902 to ensure a consistent mixture of the paint constituents. In FIG. 10, a pen 1000 includes a flexible tube 1004 and a absorbent/permeable tip 1006, as already described. The pen 1000 further includes a mixing paddle 1012 disposed within the reservoir 1002. The paddle 1012 is preferably constructed of resilient and flexible material. Rotation of the paddle 1012, through, e.g., manipulation of the surfaces defining the reservoir 1002 (e.g., squeezing the reservoir 1002 or pushing on a surface of the reservoir 1002), stirs the paint within the reservoir 1002 to ensure a consistent mixture of the paint constituents.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A paint pen comprising:

(a) a paint reservoir adapted to hold paint and comprising a squeeze tube;

(b) a flexible and resilient tube extending along a longitudinal axis when no outside force is applied thereto;

(c) bristles that are permeable and absorbent relative to paint in the reservoir;

(d) wherein the flexible and resilient tube is connected to the paint reservoir at one end of the flexible and resilient tube and one end of the bristles is positioned within another end of the flexible and resilient tube; and (e) wherein the flexible and resilient tube flexes away from the longitudinal axis as the bristles are applying paint to a surface and flexes back to the longitudinal axis when the bristles no longer contact the surface.

2. The paint pen of claim 1 further comprising a spring disposed within the flexible and resilient tube, wherein the spring provides resiliency to the flexible and resilient tube.

3. The paint pen of claim 1 wherein the flexible and resilient tube includes circumferential ridges disposed on the outer surface of the flexible and resilient tube thereby providing resiliency to the flexible and resilient tube.

4. The paint pen of claim 1 further comprising a paddle disposed in the paint reservoir.

5. The paint pen of claim 1 further comprising a cap having an absorbent material to hold a distillate and configured to fit over the flexible and resilient tube.

* * * * *